US006219431B1

(12) United States Patent
Proni

(10) Patent No.: US 6,219,431 B1
(45) Date of Patent: Apr. 17, 2001

(54) LOUDSPEAKER WITH IMPROVED COOLING STRUCTURE

(76) Inventor: Lucio Proni, 2571 Mayfair La., Weston, FL (US) 33327

( * ) Notice: Subject to any disclaimer, the term of this patent is extended or adjusted under 35 U.S.C. 154(b) by 0 days.

(21) Appl. No.: 09/430,776

(22) Filed: Oct. 29, 1999

(51) Int. Cl.[7] ..... H04R 25/00
(52) U.S. Cl. ..... 381/397; 381/433; 381/412
(58) Field of Search ..... 381/397, 400, 381/404, 411, 412, 414, 433

(56) References Cited

U.S. PATENT DOCUMENTS

| | | | | |
|---|---|---|---|---|
| 2,429,470 | | 10/1947 | Knowles | 179/115.5 |
| 3,991,286 | | 11/1976 | Henricksen | 179/115.5 |
| 4,327,257 | | 4/1982 | Schwartz | 179/115.5 |
| 4,547,632 | | 10/1985 | Bryson | 179/115.5 |
| 4,590,332 | * | 5/1986 | Delbuck | 179/115.5 PS |
| 4,821,331 | | 4/1989 | Murayama et al. | 381/192 |
| 4,933,975 | | 6/1990 | Button | 381/192 |
| 5,042,072 | | 8/1991 | Button | 381/192 |
| 5,081,684 | | 1/1992 | House | 381/199 |
| 5,303,209 | | 4/1994 | Frasl | 367/174 |
| 5,357,586 | | 10/1994 | Nordschow | 381/199 |
| 5,497,428 | | 3/1996 | Rojas | 381/199 |
| 5,625,701 | | 4/1997 | Scanlan | 381/197 |
| 5,909,015 | | 6/1999 | Yamamoto et al. | 181/156 |
| 5,940,522 | | 8/1999 | Cahill et al. | 381/397 |

FOREIGN PATENT DOCUMENTS

| | | |
|---|---|---|
| 2667212 | 3/1992 | (FR) . |
| 3-220897 | 9/1991 | (JP) . |
| 3-239099 | 10/1991 | (JP) . |

* cited by examiner

*Primary Examiner*—Huyen Le
*Assistant Examiner*—Dionne N. Harvey
(74) *Attorney, Agent, or Firm*—Holland & Knight LLP

(57) ABSTRACT

A loudspeaker comprises a frame mounted to a motor structure, an upper suspension connected between the voice coil of the motor structure and the frame, and, a lower suspension extending from the voice coil to the frame in position to form a cavity between the top plate of the motor and the lower suspension. A flow path is formed at the juncture of the frame and top plate of the motor through which a comparatively high volume of air is circulated in and out of the cavity between the lower suspension and lower end of the frame in response to excursion of the voice coil during operation of the speaker. The flow path is positioned to direct such air flow over the top plate and at least along a portion of the voice coil to aid in cooling of these elements.

25 Claims, 8 Drawing Sheets

LOUDSPEAKER WITH IMPROVED COOLING STRUCTURE

FIELD OF THE INVENTION

This invention relates to loudspeakers, and, more particularly, to structure associated with the frame and top plate of a loudspeaker which is effective to direct a flow of cooling air along the surface of the top plate and at least a portion of the voice coil of the loudspeaker.

BACKGROUND OF THE INVENTION

Loudspeakers generally comprise a frame, motor structure, a diaphragm, a lower suspension or spider and a surround. In one common type of speaker, the motor structure includes a top plate spaced from a back plate with a permanent magnet mounted therebetween. The magnet and top plate define an air gap within which a hollow, cylindrical-shaped voice coil is axially movable with respect to a fixed pole piece which is centrally mounted atop the back plate.

The voice coil generally comprises a cylindrical former which receives a winding of wire. The diaphragm extends between the voice coil and the surround, which, in turn, is mounted to the upper end of the frame. The spider is connected at one end to the voice coil, and at its opposite end to a point between the upper and lower ends of the frame. In this construction, one cavity or space is formed in the area between the diaphragm and spider, and a second cavity is formed in the area between the spider and the top plate of the motor structure. Many speaker designs include a dust cap mounted to the diaphragm in position to overlie and cover the voice coil and pole piece.

In the course of operation of a speaker of the type described above, electrical energy is supplied to the voice coil causing it to axially move relative to the pole piece and within the air gap formed by the top plate and magnet. The diaphragm, spider and the surround, move with the excursion of the voice coil. A pervasive problem associated with speaker operation involves the build up of heat produced by the voice coil and radiated to surrounding surfaces. Both the voice coil and top plate become quite hot during speaker operation which can reduce the power handling of the speaker, and increase power compression, i.e. a reduction in acoustic output due to temperature-related voice coil resistance.

A variety of designs have been employed in the prior art to address the problems associated with heat build up in speakers. Much of the design effort has been devoted to creating a flow of cooling air over the voice coil itself, such as disclosed, for example, in U.S. Pat. Nos. 5,042,072 to Button; 5,081,684 to House; and 5,357,586 to Nordschow et al. A typical construction in speaker designs of this type involves the formation of passages in or along the voice coil which form a flow path for the transfer of cooling air from the cavity between the voice coil and the dust cap and/or diaphragm, and vent openings usually formed in the back plate of the motor structure. An air flow through these passages is created in response to movement of the diaphragm with the excursion of the voice coil. When the diaphragm moves in one direction, air is drawn from outside of the speaker, through the vent opening in the back plate, along the passages in or along the voice coil and then into the cavity. Movement of the diaphragm in the opposite direction creates a flow out of the cavity along the reverse flow path.

One problem with the approach described above is that the design and construction of the flow passages often do little more than provide venting of the area or cavity between the diaphragm and voice coil. The actual air flow generated by movement of the diaphragm is typically relatively low volume. As a result, very little cooler ambient air from outside of the speaker actually flows along the voice coil to provide effective cooling. Additionally, little or no air flow is directed along the top plate, which remains hot.

Alternative designs depend upon thermal conduction and convection to cool the voice coil and/or top plate. Typically, structure associated with the frame is positioned in engagement with or proximate the top plate of the motor to provide a heat sink or thermally conductive path along which heat can move from the relatively hot top plate to the relatively cool frame. See, for example, U.S. Pat No. 4,933,975 to Button and French Application FR 2667212-A.

Constructions of the type described above provide some benefit, but reliance on conduction and convection alone to remove heat from the top plate and voice coil is of limited effectiveness with today's high performance, high excursion speakers. This is particularly true in applications such as vehicle speakers where space is at a premium and the speaker frame must be as compact as possible. In such designs, it is often not feasible to incorporate additional frame structure whose purpose is primarily or exclusively intended for the conduction of heat away from the voice coil and top plate.

SUMMARY OF THE INVENTION

It is therefore among the objectives of this invention to provide a loudspeaker construction which provides a comparatively high velocity, high volume flow of cooling air over the top plate and at least a portion of voice coil of the motor structure, which increases power handling of the speaker, which reduces power compression and which is efficient and economical to manufacture.

These objectives are accomplished in a loudspeaker including a frame mounted to a motor structure, a diaphragm connected between the voice coil of the motor structure and a surround carried by the frame, and, a spider extending from the voice coil to the frame in position to form a cavity between the top plate of the motor and the spider. An air flow path is formed at the juncture of the frame and top plate of the motor through which a comparatively high volume of cooling air is circulated at relatively high velocity in and out of the cavity between the spider and top plate in response to excursion of the voice coil during operation of the speaker. The air flow path is positioned to direct such cooling air over the top plate and at least along a portion of the voice coil to aid in cooling of these elements.

This invention is predicated upon the concept of using the "pumping" action of the diaphragm and spider created by excursion of the voice coil to obtain a high volume, high velocity flow of cooling air in and out of the cavity formed between the spider and top plate, along a flow path which is thermally adjacent to the top plate and voice coil. A stand-off is located between the bottom of the frame and the top plate of the motor to form the flow path for the cooling air moving in and out of the cavity. In some embodiments, the cooling air is made to flow directly into contact with the voice coil in the course of movement in and out of the cavity. Alternatively, the frame is formed with an inner ring which encircles the voice coil and directs the air flow in and out of the cavity through bores formed in the bottom of the frame.

In one group of presently preferred embodiments, the frame is fabricated from comparatively thin sheet metal in a stamping operation which forms a bottom surface. In one particular embodiment, a series of circumferentially spaced inserts or spacers are located between the bottom surface of the frame and the top plate of the motor to create a flow path for the cooling air entering and leaving the cavity. Alternatively, the stand-offs comprise extrusions or detents formed either in the top plate or the bottom surface of the frame, which are circumferentially spaced from one another to create the spacing between the frame and top plate. In all of these embodiments, the space formed between the bottom of the frame and the top plate defines the flow path for cooling air moving in and out of the speaker. When the voice coil axially moves in one direction, a flow of comparatively cool, ambient air from outside of the speaker is drawn into the speaker, over the top plate and against at least a portion of the voice coil into the cavity between the lower suspension and the top plate. Upon movement of the voice coil in the opposite direction, the air within such cavity is forced out of the cavity in the reverse direction along the same flow path.

In an alternative group of embodiments, the frame has a cast construction with a bottom surface formed with a number of circumferentially spaced extensions which rest against the top plate to form a flow path for transmitting cooling air toward the voice coil. The flow path in some cast frame designs directs cooling air against the voice coil as it enters and leaves the cavity between the spider and top plate. In one alternative embodiment, the bottom of the cast frame is formed with a ring which encircles the voice coil so that the air flow into and out of the cavity is prevented from directly impinging against the voice coil, but instead flows through bores formed in the bottom of the frame which communicate with the cavity. This flow of air is intended to transfer heat from the ring, which, in turn, conducts heat away from the voice coil.

DESCRIPTION OF THE DRAWINGS

The structure, operation and advantages of the presently referred embodiment of this invention will become further apparent upon consideration of the following description taken in conjunction with the accompanying drawings, wherein.

DETAILED DESCRIPTION OF THE PREFERRED EMBODIMENT

Figure 3:
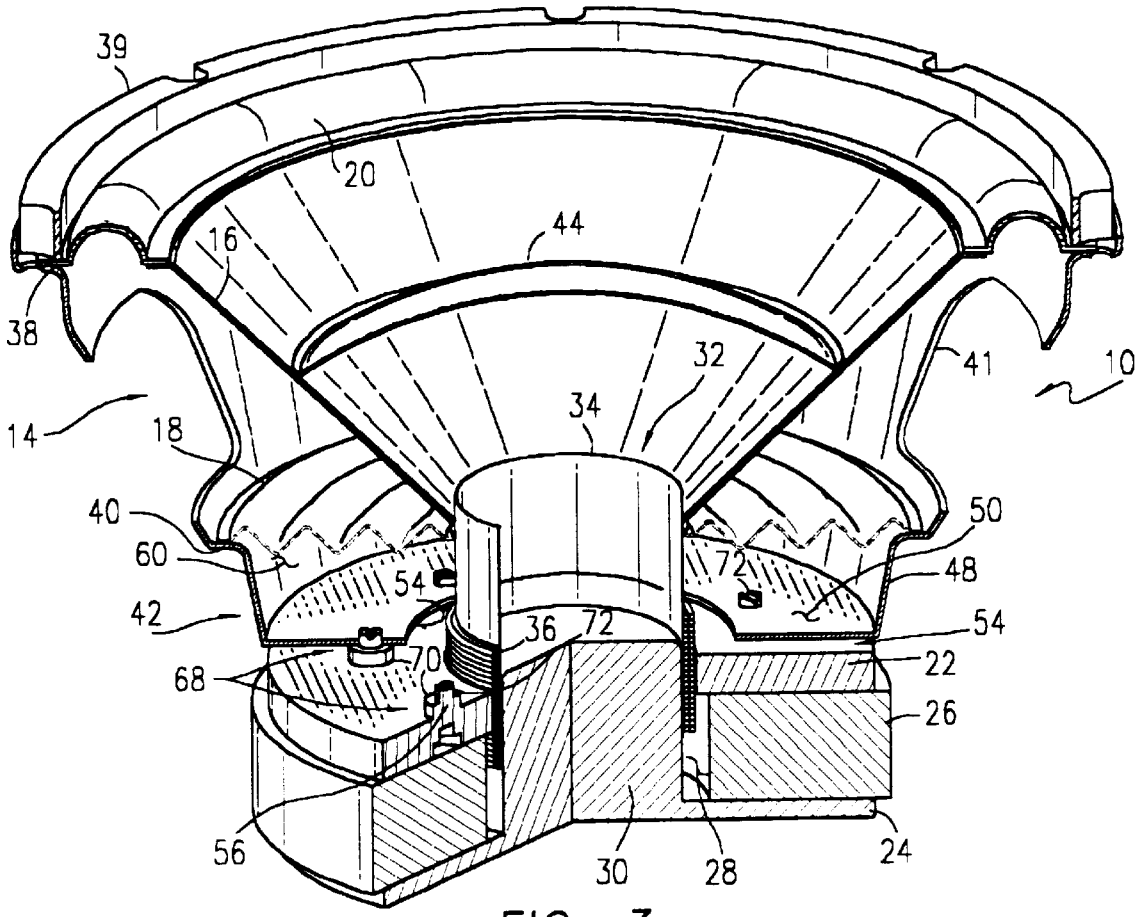
FIG. 3 is a perspective, cross sectional view depicting a still further stand-off embodiment.
Figure 4:
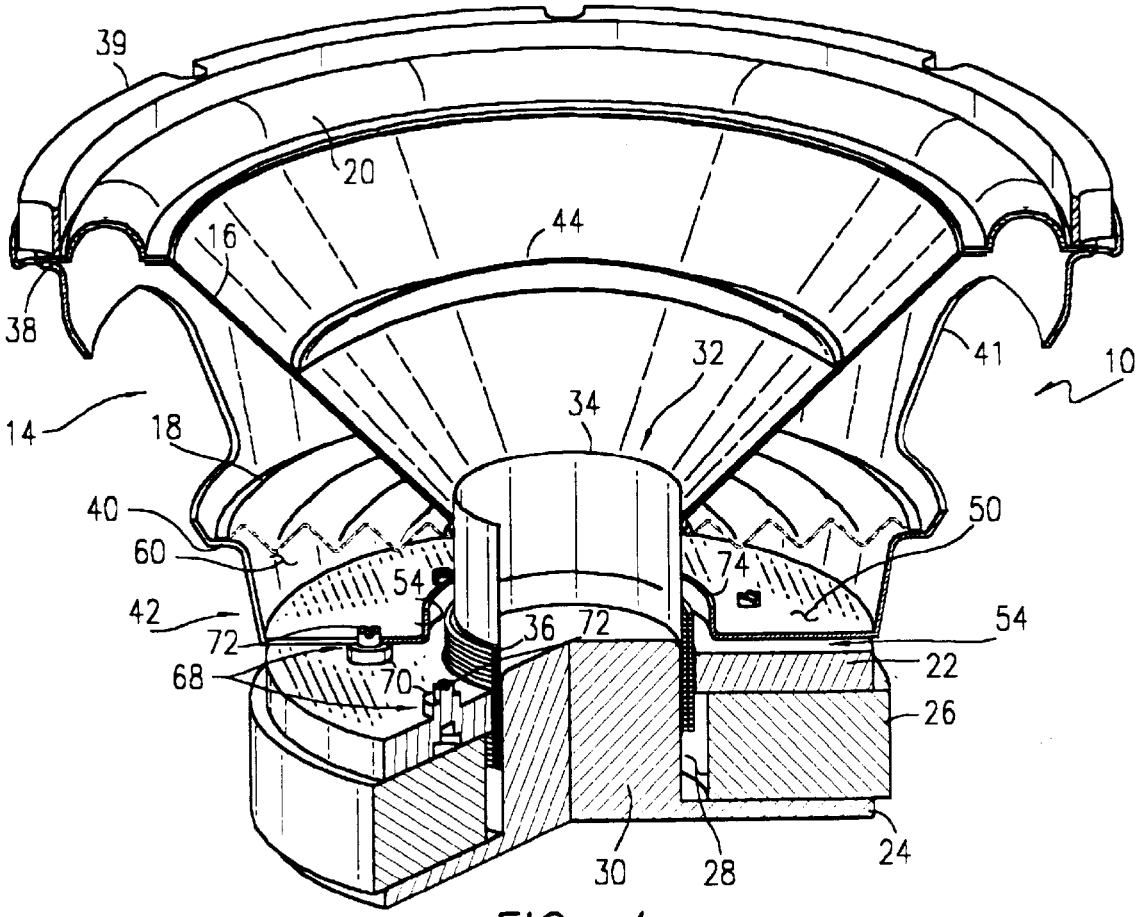
FIG. 4 is a view similar to FIG. 3 except with the bottom surface of the frame formed with a vertically upwardly extending lip.
Figure 5:
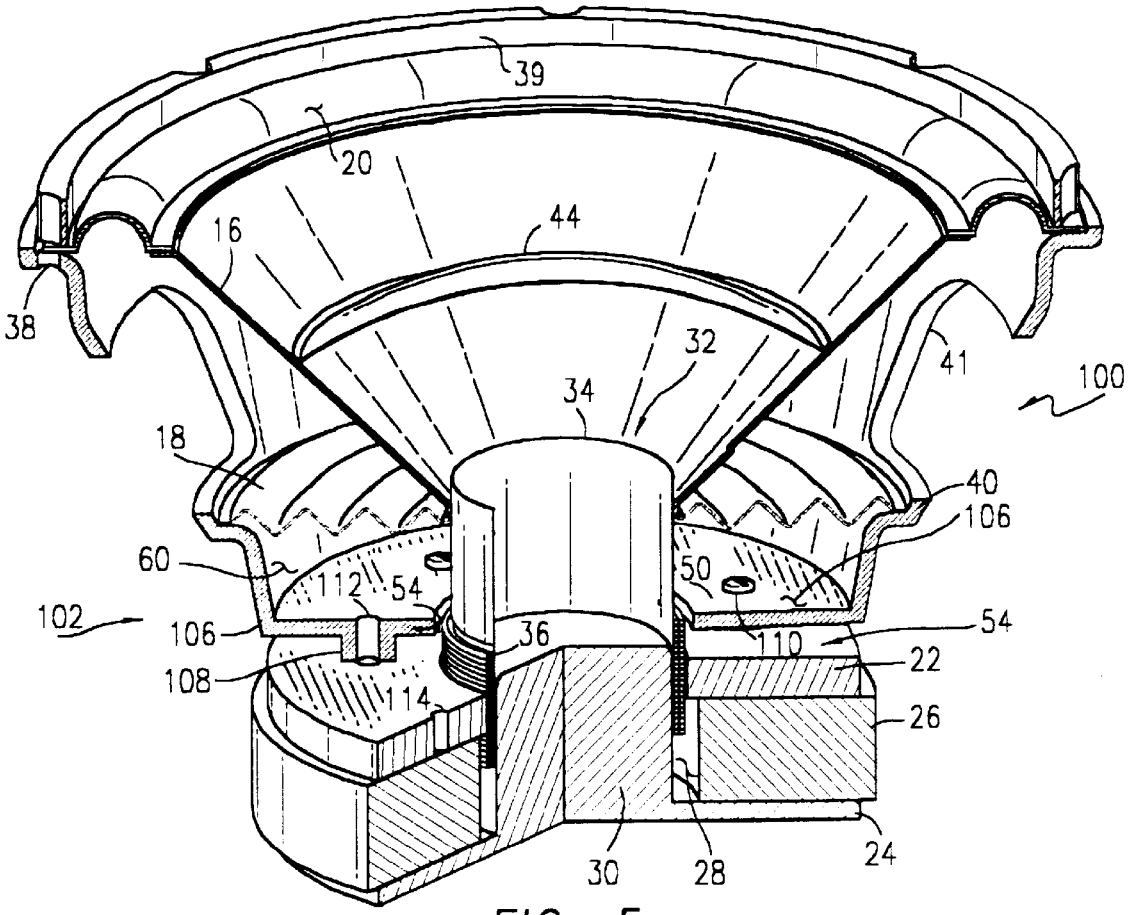
FIG. 5 is a perspective, cross-sectional view of a speaker construction according to this invention employing a cast frame having a bottom surface formed with extensions resting atop the top plate.
Figure 6:
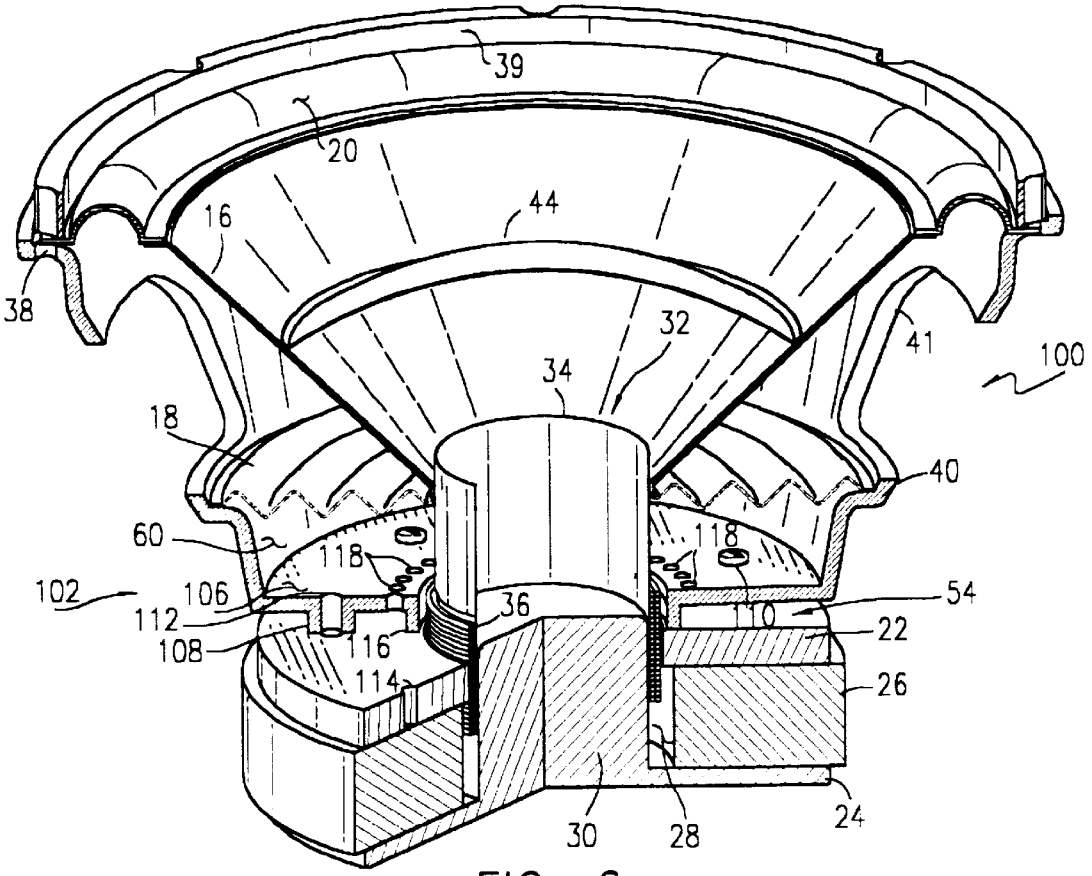
FIG. 6 is a perspective, cross-sectional view of an alternative embodiment of a speaker having a cast frame formed with spaced extensions, a collar encircling the voice coil and bores formed in the bottom of the frame.
Figure 7:
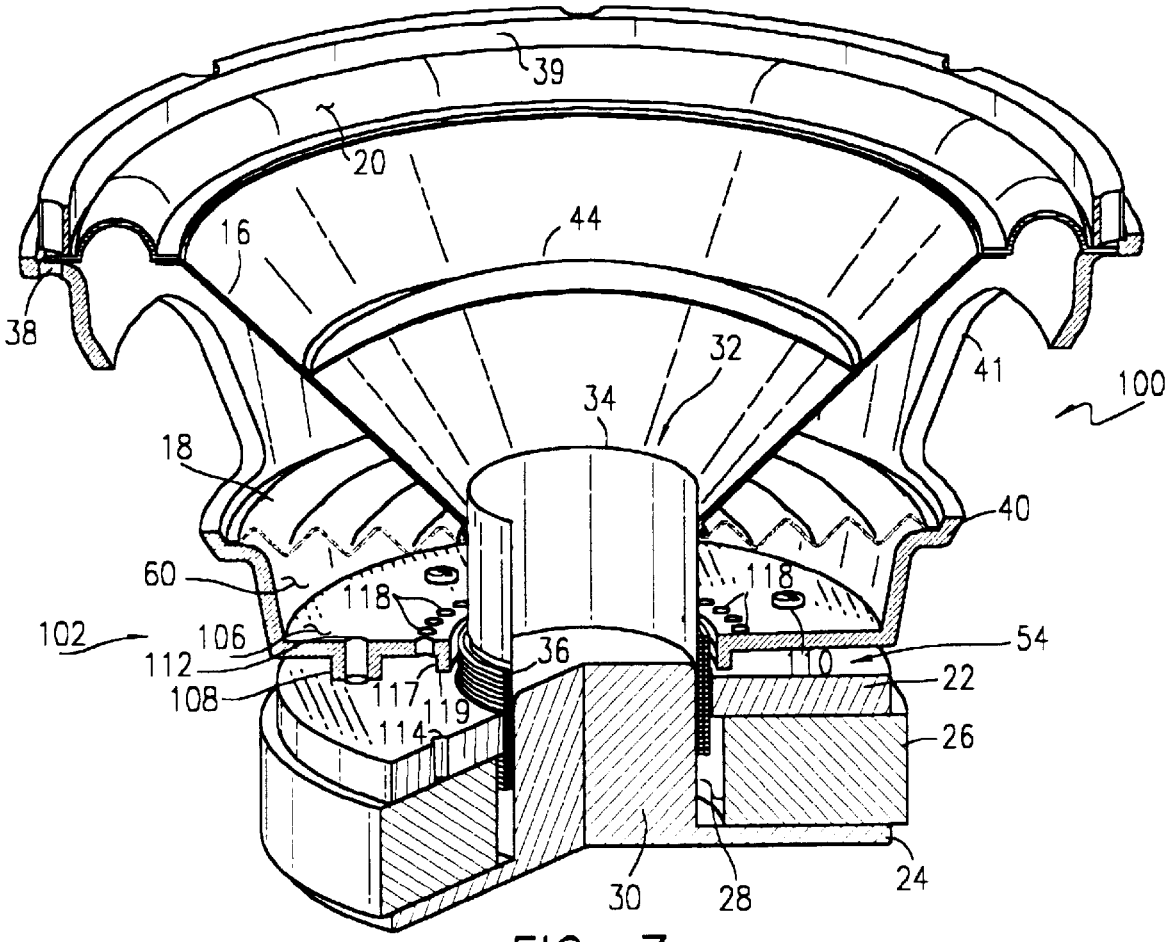
FIG. 7 is view similar to FIG. 6, except with an inner ring which is spaced from the top plate of the motor.
Figure 8:
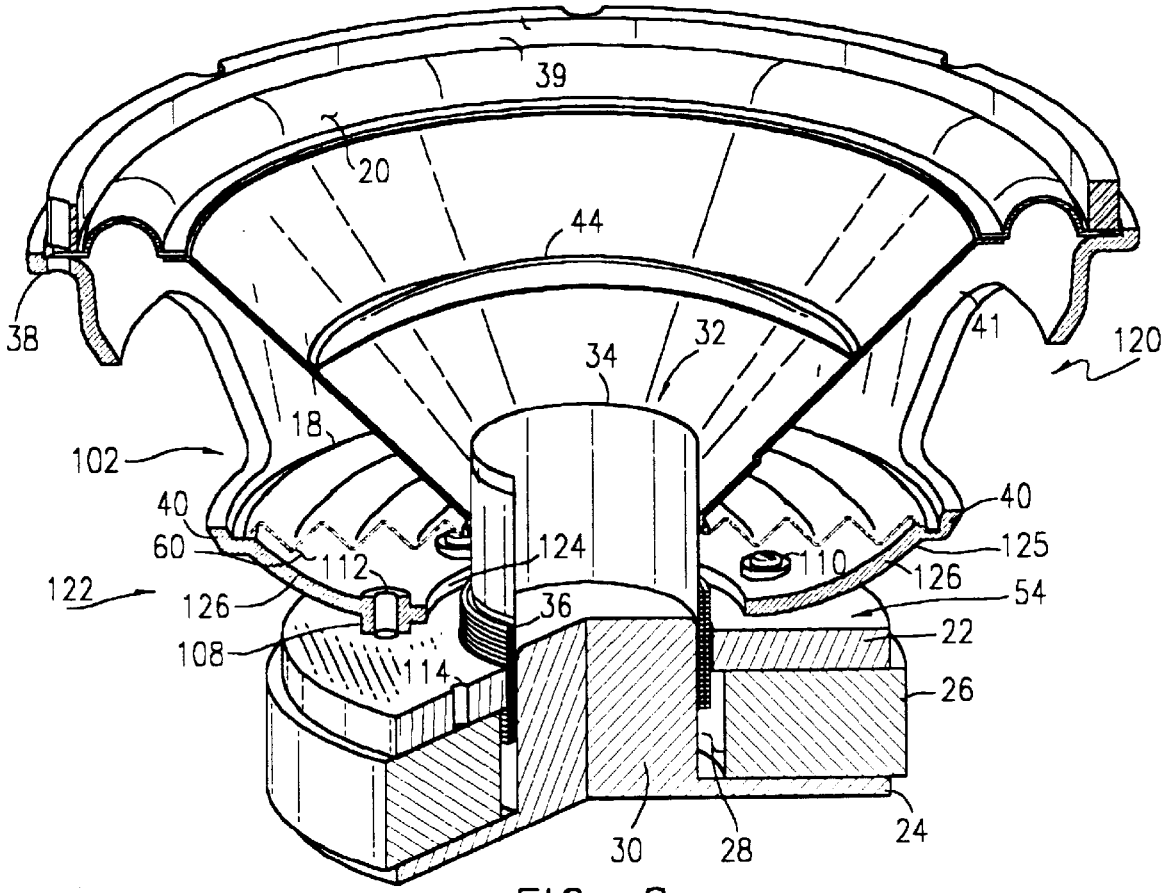
FIG. 8 is a view similar to FIG. 5, except with a portion of the bottom of the frame angled upwardly with respect to the top plate of the motor.

Referring now to the drawings, one group of embodiments of a loudspeaker 10 is illustrated in FIGS. 1–4, a second group of embodiments depicting a loudspeaker 100 are shown in FIGS. 5–7, and a third loudspeaker 120 is shown in FIG. 8. The speakers 10, 100 and 120 each generally comprise a motor structure 12, a diaphragm 16, a lower suspension or spider 18 and a surround 20. The speakers 10 illustrated in FIGS. 1–4 include a frame 14 which is preferably fabricated from a relatively thin sheet metal which can be formed in a stamping operation or the like. A cast frame 102 is employed in the speakers 100 and 120 of FIGS. 5–8. Except for specific differences in a portion of the construction of frames 14 and 102 and/or the manner of mounting the frames 14, 102, to the motor structure 12, as described below, the speakers 10, 100 and 120 have the same construction. Consequently, the same reference numbers are used in each of the FIGS. 1–8 to denote the same structure, and the overall speaker design is discussed with reference to speaker 10, it being understood that the same description applies to speakers 100 and 120.

Conventionally, the motor structure 12 includes a top plate 22 and a back plate 24 which are spaced from one another and mount a permanent magnet 26 therebetween. The central bore 28 of the magnet 26 and the top plate 22 form an air gap within which a pole piece 30 is mounted atop the back plate 24. A voice coil 32 is concentrically disposed about the pole piece 30, and axially movable relative thereto during operation of the speaker 10. Preferably, the voice coil 32 includes a hollow, cylindrical-shaped former 34, whose exterior surface receives a wire winding 36.

Figure 1:
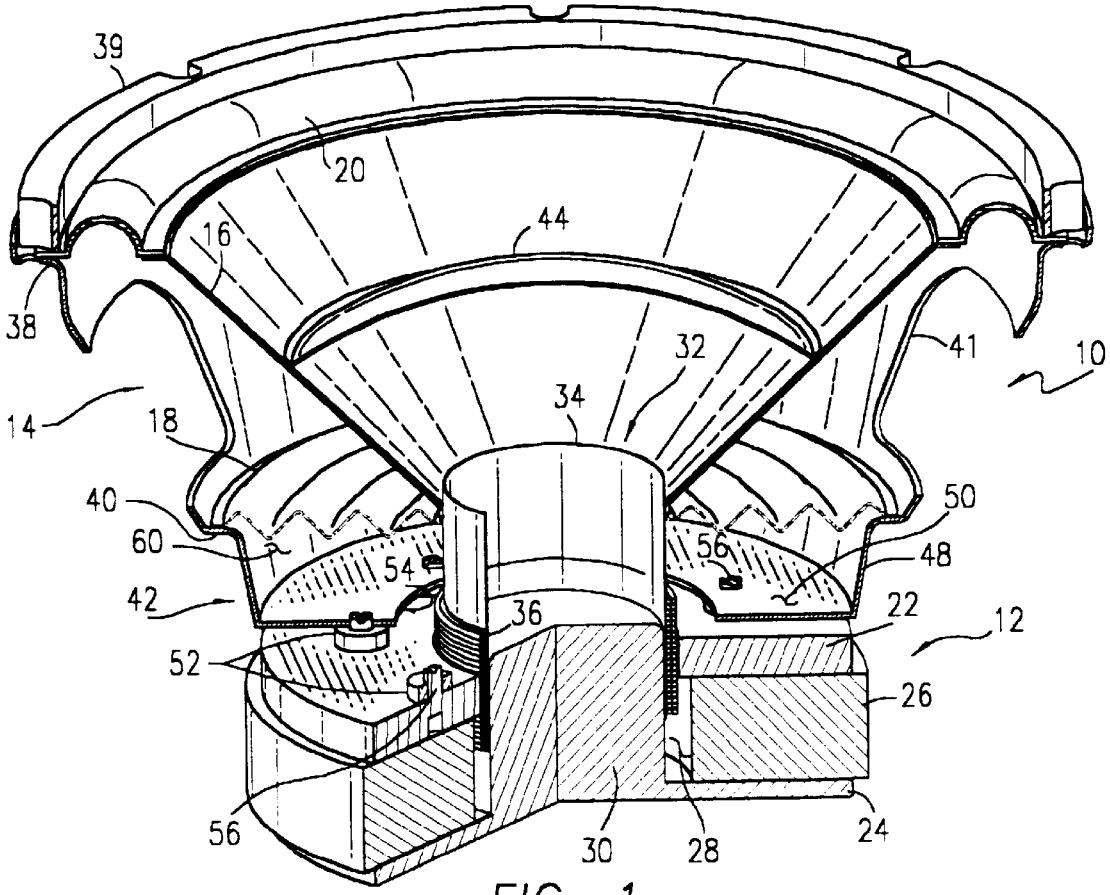
FIG. 1 is a perspective, cross sectional view of one embodiment of the speaker of this invention employing spacers to create a space between the frame and top plate.

The voice coil 32 is held in place with respect to the pole piece 30 by the diaphragm 16, the spider 18 and the surround 20. One end of the diaphragm 16 is affixed to the former 34 by adhesive or the like, and its opposite end connects to the surround 20. The surround 20, in turn, is mounted by adhesive to a seat 38 formed at the upper end of frame 14 and partially covered by a speaker gasket 39 as shown in FIG. 1. The diaphragm 16 and surround 20 collectively form an upper suspension to support the voice coil 32. Similarly, the lower suspension or spider 18 mounts to the former 34 in the same location as the diaphragm 16, and the opposite end of spider 18 is mounted to a shoulder 40 formed in the lower end 42 of frame 14. A dust cap 44 is mounted near the lower end of the diaphragm 16 immediately above the former 34 which, when connected to the diaphragm 16 and spider 18 as shown, is concentrically disposed about the pole piece 30. For purposes of the present discussion, the terms "upper" or "upwardly" refer to the vertically upward direction in the orientation of the speaker 10 depicted in FIG. 1. The terms "lower" or "downwardly" refer to the opposite direction.

In the embodiments of speaker 10 illustrated in FIGS. 1–4, the upper portion of the frame 14 is formed with a number of spaced openings or windows 41. The lower end 42 of frame 14 is formed with an downwardly extending wall 48 beneath the shoulder 40 which, in turn, is integrally connected to an annular or ring-shaped bottom portion 50 which forms the base of the frame 14. This bottom portion 50 of the frame 14 rests atop a number of stand-offs or spacers 52, preferably formed of a thermally conductive material, which, in turn, mount to the top plate 22. The spacers 52 are circumferentially spaced along the top plate 22, and collectively provide a flow path 54 between the bottom portion 50 of frame 14 and the top plate 22 of motor 12.

In the embodiment of FIG. 1, an extrusion 56 extends upwardly from the top plate 22 where each spacer 52 is located. Each extrusion 56 protrudes through a central bore in a corresponding spacer 52, and through a bore formed in the bottom portion 50 of frame 14. The top edge of each extrusion 56 is bent over or staked against the bottom portion 50 of fame 14, as shown in FIG. 1, to securely interconnect the frame 14, spacers 52, and top plate 22. Alternatively, the spacers 52 can be mounted between the top plate 22 and frame 14 with screws, rivets, pins or other mounting devices.

In the course of normal operation of the speaker 10, the voice coil 32 is moved vertically upwardly and downwardly with respect to the pole piece 30. Because the diaphragm 16 and spider 18 are mounted to the voice coil 32, these elements also move vertically during speaker operation. The purpose of the flow path 54 formed by the spacers 52 between the bottom 50 of frame 14 and top the plate 22 is to take advantage of the natural "pumping" action of the diaphragm 16, and to a lesser extent the lower suspension or spider 18. When the diaphragm 16 and spider 18 are moved vertically upwardly in response to excursion of the voice coil 32, ambient air from outside the speaker 10 is drawn through the flow path 54 into a cavity 60 which is formed between the spider 18, and the top plate 22 and lower end 42 of frame 14. Conversely, in the course of movement of the diaphragm 16 and spider 18 vertically downwardly with the voice coil 32, air within the cavity 60 is forced outwardly through the flow path 54 to a location externally of the speaker 10. The flow path 54 between the frame 14 and top plate 22 is positioned to transmit air entering and leaving the cavity 60 directly over the top plate 22 and against the voice coil 32. These elements comprise two of the hottest areas of the speaker 10 during its operation and need to be cooled, to the extent possible, to maximize the power handling of the speaker and reduce power compression. The comparatively cool, ambient air drawn into the speaker 10 via the flow path 54 as described above provides significant cooling and heat transfer away from the top plate 22 and voice coil 32.

Figure 2:
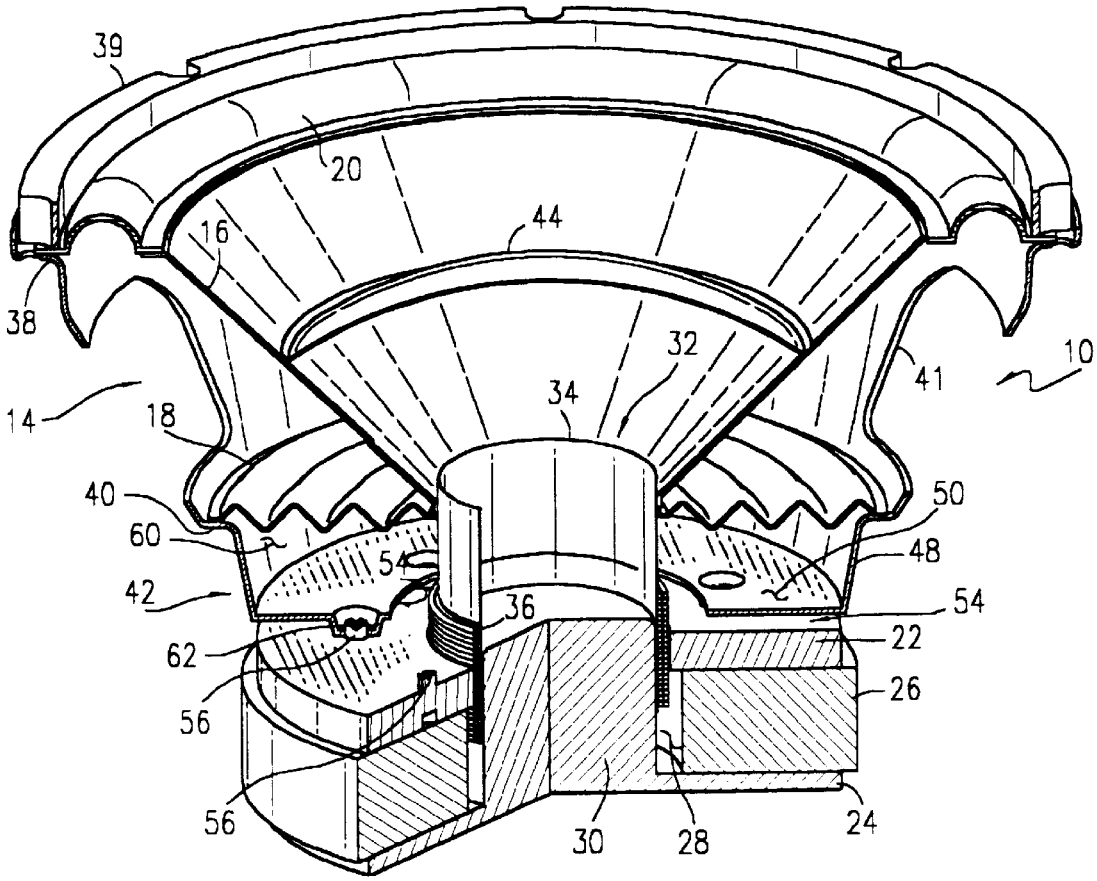
FIG. 2 is view similar to FIG. 1 except of an alternative stand-off construction.

Referring now to FIG. 2, an alternative embodiment of the speaker 10 is illustrated in which the bottom portion 50 of the lower end 42 of frame 14 is formed with a number of circumferentially spaced, basket-shaped detents 62 each having a throughbore. The stand-off or detents 62 extend vertically downwardly from the remainder of the bottom portion 50 and rest atop the top plate 22 to form a flow path 54 therebetween. The frame 14 is secured to the motor structure 12 by extrusions 56 formed in the top plate 22, each of which protrudes through a detent 62 where they are bent over or staked in place against the interior thereof. The flow path 54 provided by the extrusions is substantially the same as that described above in connection with the embodiment of FIG. 1, and, consequently, essentially the same flow of cooling air into and out of the cavity 60 is achieved in this embodiment of speaker 10.

A still further embodiment of a stand-off construction for spacing the lower end 42 of frame 14 vertically above the top plate 22 of motor structure 12 is shown in FIGS. 3 and 4. In these embodiments, the top plate 22 is formed with a series of circumferentially spaced extrusions 68. Each extrusion 68, in turn, has a base section 70 and an extension 72. The lower end 42 of frame 14 rests atop the base section 70 of each extrusion 68, and the extension 72 of each extrusion 68 protrudes through one of a number of circumferentially spaced bores formed in the bottom portion 50 of frame 14. The extensions 72 are bent over or staked as depicted in FIGS. 3 and 4 to secure the frame 14 in place atop the top plate 22. The space between the frame 14 and top plate 22 which is created by the extrusions 68 forms essentially the same flow path 54 as described above in the previous embodiments of this invention.

The distinction between the speakers 10 illustrated in FIGS. 3 and 4 is that a vertically upwardly extending ring 74 is formed on the inside edge of the bottom portion 50 of the frame 14 in FIG. 4. The ring 74 is concentrically disposed about the voice coil 32 and in relatively close proximity thereto. Although the flow path 54 of the speakers 10 depicted in both FIGS. 3 and 4 transmits cooling directly against the voice coil 32, the ring 74 functions to direct the air flow from the flow path 54 in a generally vertically upward direction in and out of the cavity 60. Because the ring 74 is located immediately adjacent to and encircles the voice coil 32, the ring 74 tends to maintain the flow of cooling air proximate to the voice coil 32 for a longer period of time than can be achieved with the frame construction shown in FIG. 3. Additionally, the ring 74 conducts at least some of the heat produced by the voice coil 32 to the remainder of the frame 14. Consequently, improved heat transfer is obtained by the combination of conduction along the frame 14, and the passage of cooling air along the voice coil 32, with the construction of speaker 10 illustrated in FIG. 4.

Referring now to FIGS. 5–7, speakers 100 are illustrated which employ a cast frame 102 instead of the sheet metal, stamped frames 14 of the speakers 10 of FIGS. 1–4. The same concept of creating a space between the frame 102 and top plate 22 of motor 12 is present in the speakers 100, as described above with reference to speakers 10, with some variation in the particular structure of speakers 100 as described below.

The speakers 100 in FIGS. 5–7 are similar to one another in that they include a frame 102 having a bottom portion 106 formed with circumferentially spaced, cast extensions 108. The stand-offs or extensions 108 rest atop the top plate 22 to form essentially the same flow path 54 as described above in connection with the previous embodiments. Each extension 108 is secured to the top plate 22 by a screw 110 which extends through a bore 112 in the extension 108 and into a bore 114 formed in the top plate 22. The top plate bores 114 can be tapped, or, alternatively, self-tapping screws 110 are used.

The bottom portion 106 of frame 102 in the speaker 100 of FIG. 5 is spaced from the voice coil 32 approximately the same distance as are the frame bottoms 50 in the speakers 10 depicted in FIGS. 1–4. A similar air flow in and out of cavity 60 is therefore produced, wherein ambient air from outside of the speaker 100 is transmitted via the low path 54 along the top plate 22, against the voice coil 32 and into the cavity 60 when the voice coil moves in one direction. The air exits the cavity 60 along the reverse flow path when the voice coil 32 moves in the opposite direction.

In the embodiment of speaker 100 shown in FIG. 6, a collar 116 is provided which extends vertically downwardly from the inner diameter of the bottom portion 106 of frame 102 and rests atop the top plate 22. The collar 116 is located relatively close to the voice coil 22, compared to the position of the inner diameter of the frame 14 or frame 102 in previous embodiments, and a number of circumferentially spaced holes 118 are formed in the bottom portion 106 of the frame 102 in FIG. 6 at a location radially outwardly from the collar 116.

The construction of the speaker 100 depicted in FIG. 6 provides for a somewhat different manner of heat transfer from the top plate 22 and voice coil 32 than that described in FIGS. 1–5. In FIG. 6, the close proximity of the collar 116 to the voice coil 32 results in the conduction of heat from the voice coil 32 into the collar 116, and, in turn, to the bottom portion 106 of frame 102. Cooling air entering the speaker 100 via the flow path 54 created between the frame 102 and top plate 22 is directed against the collar 116 and flows through the holes 118 in and out of the cavity 60. In the course of movement along this path, heat transfer occurs between the cooling air and the top plate 22, and between the cooling air and the collar 116 as well as a portion of the frame 102. Unlike the embodiments described in connection with a discussion of FIGS. 1–5, there is little or no direct contact of the cooling air with the voice coil 22 in the speaker 100 of FIG. 6.

The speaker 100 illustrated in FIG. 7 is modified to some extent from that depicted in FIG. 6 with respect to the structure in the area of voice coil 32. In this embodiment, a collar 117 is mounted along the inner diameter of the bottom portion 106 of frame 102, but unlike the collar 116 of FIG. 6, the collar 117 extends only part way toward the top plate 22 and has a bottom edge 119 which is spaced therefrom. The same circumferentially spaced holes 118 employed in the embodiment of FIG. 6 are present in the speaker 100 of FIG. 7.

The purpose of the space between collar 117 and top plate 22 is to provide an additional flow path for the cooling air entering and leaving cavity 61. At least some of the cooling air transmitted through the flow path 54 is directed against the collar 117 and into holes 118 as in FIG. 6, but the space between the collar 117 and top plate 22 also permits the flow of cooling air directly against the voice coil 32 as in the embodiments of FIGS. 1–5. As such, the speaker 100 depicted in FIG. 7 employs a combination of the heat transfer characteristics found in all of the previously described embodiments.

A still further embodiment of this invention is illustrated in the speaker 120 of FIG. 8. The speaker 120 is similar to speaker 100 shown in FIG. 5, except for the configuration of the bottom portion 122 of the frame 102. Preferably, the bottom portion 122 of speaker 120 is substantially parallel to the top plate 22 from its inner edge 124 to the area where the extensions 108 are formed, but then a tapered portion 126 extends from the extensions 108 to the outer edge 125 thereof, i.e., in the area of the seat 40 where the spider 18 is mounted. The tapered portion 126 is angled upwardly from the top plate 22 so that the space or cross sectional area therebetween increases in a direction from the extensions 108 to the seat 40.

As described above, the flow of cooling air in and out of the cavity 60 is obtained by the pumping action of the diaphragm 18 and spider 18. The cooling air is drawn from outside of the speakers 10 and 100 into the cavity 60 in response to movement of the diaphragm 16 and spider 18 in a vertically upward direction, and then the air exits the cavity 60 upon movement of the diaphragm 16 and spider 18 in the opposite direction. In the embodiments of FIGS. 1–7, the flow path 54 between the bottom of the frame 14 or 102, and the top plate 22, has substantially the same height dimension from the outside of the frame 14 or 102 to the voice coil 32. It is contemplated that while there is movement of air in and out of cavity 60 with this construction, there may be a limited exchange of "new" or fresh air within the cavity 60 during operation of the speakers 10 and 100.

The speaker 120 is designed to obtain a more complete exchange of the air within cavity 60 than is achieved with the embodiments of FIGS. 1–7. As noted above, the bottom portion 122 of speaker 120 is spaced increasingly further away from the top plate 22 from its inner edge 124 to the seat of frame 40, particularly along the tapered portion 126. In response to movement of the diaphragm 16 and spider 18 in the vertically upward direction, a comparatively large volume of air enters the cavity 60 because the velocity of the air flow is increased in moving from the larger cross sectional area leading into the tapered portion 126 of the frame 102 to the relatively small cross sectional area at the inner edge 124 of the frame 102 near the voice coil 32. More air, in turn, enters the cavity 60 than can be obtained with the embodiments of FIGS. 1–7. When the diaphragm 16 and spider 18 move in the opposite direction, air is emitted from the cavity 60 but at a comparatively lower velocity and lower volume because the flow of air is transmitted from the smaller cross sectional area near the voice coil 32 to the larger cross sectional area at the tapered portion 126 of the frame 102. The additional volume of air entering the cavity 60, compared to the volume exhausted as the voice coil 32 moves downwardly, is simply vented through the relatively porous spider 18.

The overall intent of the speaker design in FIG. 8 is to obtain a higher volume flow of cooling air from outside of the speaker 120 into the cavity 60 so that the air within the cavity 60 is circulated and exchanged, rather than the same air simply being "recycled" or alternately moved in and out of the cavity 60 in the course of operation of the speaker 120. Although the embodiments of speaker 10 depicted in FIGS. 1–7 do provide an increasingly larger area in moving from the inside diameter of the bottom plate 50 to its outside diameter, i.e., the overall cross sectional area of the flow path 54 at the inside diameter of bottom plate 50 is less than that at the outside diameter, the tapered design of the bottom portion 122 of the speaker 10 in FIG. 8 nevertheless promotes an even greater inflow of air to the cavity 60 via flow path 54 and therefore improved exchange of cooling air within the speaker 10. It is contemplated that the design of the bottom portion 122 of speaker 120 could be incorporated into the speakers 10 and 100 depicted in FIGS. 1–6, to obtain the same benefit described above.

While the invention has been described with reference to a preferred embodiment, it should be understood by those skilled in the art that various changes may be made in equivalents and may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the intended claims.

What is claimed is:

1. A loudspeaker, comprising:

a motor including a top plate having an upper surface, and a movable voice coil;

a frame having an upper end, and a lower end carried by said top plate;

a surround connected to said first end of said frame, and a diaphragm connected between said surround and said voice coil;

a lower suspension connected at one end to said voice coil, and at the other end to said frame at a location between said upper and lower ends of said frame, a cavity being formed in the area between said lower suspension and said lower end of said frame;

cooling structure associated with at least one of said top plate and said frame, said cooling structure including a number of stand-offs located between said upper surface of said top plate and said lower end of said frame, said stand-offs forming a flow path between said upper surface of said top plate and said lower end of said frame along which a flow of air is directed in and out of said cavity and in thermal communication with at least said top plate of said motor, in response to movement of said voice coil.

2. The loudspeaker of claim 1 in which each of said stand-offs is a spacer formed of thermally conductive material.

3. The loudspeaker of claim 2 in which each of said spacers is mounted to said top plate by an extrusion formed in said top plate.

4. The loudspeaker of claim 1 in which each of said stand-offs is an extrusion extending from said top plate, said extrusions being connected to said lower end of said frame to form said flow path between said upper surface of said top plate and said lower end of said frame.

5. The loudspeaker of claim 4 in which each of said extrusions is formed with a base section to receive and support said lower end of said frame and an extension which bends over against said lower end of said frame to secure it to said base section.

6. The loudspeaker of claim 1 in which each of said stand-offs is a detent formed in said lower end of said frame, said top plate being formed with a number of spaced extrusions each extending through a bore in a detent and attaching thereto to interconnect said frame and said top plate.

7. The loudspeaker of claim 1 in which said flow path directs said flow of air against said voice coil.

8. The loudspeaker of claim 1 in which the flow path between said upper surface of said top plate of said motor and said lower end of said frame has a substantially constant height dimension.

9. The loudspeaker of claim 1 in which said lower end of said frame has an inner edge located in the area of said voice coil and an outer edge spaced from said inner edge, said lower end of said frame being formed so that the height dimension of said flow path increases in a direction from said inner edge toward said outer edge.

10. The loudspeaker of claim 1 in which each of said stand-offs is an extension formed in said lower end of said frame, each of said extensions having a throughbore which receives a fastener extending into said top plate.

11. The loudspeaker of claim 1 in which said lower end of said frame has an inner edge closest to said voice coil, said cooling structure further including a ring extending from said inner edge of said lower end of said frame and at least partially into said cavity, said ring being effective to direct air flowing within said flow path along at least a portion of said voice coil.

12. The loudspeaker of claim 1 in which each of said stand-offs has substantially the same height dimension, said flow path having a substantially constant height dimension between said upper surface of said top plate and said lower end of said frame.

13. A loudspeaker comprising:

a motor including a top plate having an upper surface, and a movable voice coil;

a frame including an upper end, and a lower end carried by said top plate, said lower end having an inner edge located proximate said voice coil and an outer edge spaced from said inner edge;

a surround connected to said first end of said frame, and a diaphragm connected between said surround and said voice coil;

a lower suspension connected at one end to said voice coil, and at the other end to said frame at a location between said upper and lower ends of said frame, a cavity being formed in the area between said lower suspension and said lower end of said frame;

cooling structure associated with at least one of said top plate and said frame, said cooling structure including a number of stand-offs located between said top plate and said lower end of said frame to provide a space therebetween, said lower end of said frame and said upper surface of said top plate collectively forming a flow path in said space therebetween which increases in height dimension from said inner edge to said outer edge of said lower end of said frame, a flow of air being directed in and out of said cavity along said flow path which is in thermal communication with at least said top plate of said motor.

14. The loudspeaker of claim 13 in which each of said stand-offs is an extension formed in said lower end of said frame, each of said extensions having a throughbore which receives a fastener extending into said top plate.

15. A loudspeaker, comprising:

a motor including a top plate having an upper surface, and a movable voice coil;

a frame including an upper end, and a lower end carried by said top plate, said lower end having an inner edge located proximate said voice coil and an outer edge spaced from said inner edge;

a surround connected to said upper end of said frame, and a diaphragm connected between said surround and said voice coil;

a lower suspension connected at one end to said voice coil, and at the other end to said frame at a location between said upper and lower ends of said frame, a cavity being formed in the area between said lower suspension and said lower end of said frame;

cooling structure associated with at least one of said top plate and said frame, said cooling structure including:

(i) a number of stand-offs located between said top plate and said lower end of said frame said stand-offs forming a flow path between said upper surface of said top plate and said lower end of said frame;

(ii) a collar mounted to said inner edge of said lower end of said frame, said collar resting atop said upper surface of said top plate and being concentrically disposed about said voice coil; and (iii) a number of bores formed in said lower end of said frame proximate said collar between said upper surface of said top plate and said lower end of said frame;

a flow of air being directed in and out of said cavity, in response to movement of said voice coil, which is transmitted along said top plate within said flow path, against said collar and through said bores in said second end of said frame.

16. The loudspeaker of claim 15 in which each of said stand-offs is an extension formed in said lower end of said frame, each of said extensions having a throughbore which receives a fastener extending into said top plate.

17. The loudspeaker of claim 15 in which said collar is located in thermal communication with said voice coil.

18. The loudspeaker of claim 15 in which each of said stand-offs has substantially the same height dimension, said flow path having a substantially constant height dimension between said upper surface of said top plate and said lower end of said frame.

19. A loudspeaker, comprising:

a motor including a top plate having an upper surface, and a movable voice coil;

a frame including an upper end, and a lower end carried by said top plate, said lower end having an inner edge located proximate said voice coil and an outer edge spaced from said inner edge;

a surround connected to said first end of said frame and a diaphragm connected between said surround and said voice coil;

a lower suspension connected at one end to said voice coil, and at the other end to said frame at a location between said upper and lower ends of said frame, a cavity being formed in the area between said lower suspension and said lower end of said frame;

cooling structure associated with at least one of said top plate and said frame, said cooling structure including:

(i) a number of stand-offs located between said top plate and said lower end of said frame said stand-offs forming a flow path between said upper surface of said to plate and said lower end of said frame;

(ii) a collar mounted to said inner edge of said end of said frame, said collar being spaced from said upper surface of said top plate and being concentrically disposed about said voice coil; and (iii) a number of bores formed in said lower end of said frame proximate said collar;

a flow of air being directed in and out of said cavity in response to movement of said voice coil, a portion of said flow of air being transmitted along said top plate and into engagement with said voice coil and another portion of said flow of air contacting said collar in the course of passing into and out of said cavity through said bores.

20. The loudspeaker of claim 19 in which each of said stand-offs is an extension formed in said lower end of said frame, each of said extensions having a throughbore which receives a fastener extending into said top plate.

21. The loudspeaker of claim 19 in which said collar is located in thermal communication with said voice coil.

22. The method of cooling the top plate and the voice coil of the motor of a loudspeaker, including a frame with an upper end and a lower end having inner and outer edges, comprising:

providing a flow path in the area between the lower end of the frame of the loudspeaker and the upper surface of the top plate of the motor whose cross sectional area increases in a direction from the inner edge of the lower end of the frame adjacent to the voice coil toward the outer edge of the lower end of the frame;

introducing air into the flow path in response to movement of the voice coil in a first direction so that the velocity of the air increases in the course of movement from the larger cross sectional area to the small cross section area of the flow path, the air being directed into a cavity formed between the lower suspension of the loudspeaker and the lower end of the frame;

discharging air from the cavity in response to movement of the voice coil in a second direction opposite to the first direction, the air exiting the cavity flowing at a comparatively slower velocity in moving from the smaller to the larger cross sectional area of the flow path.

23. The method of claim 22 in which said step of providing a flow path includes providing a path for the transmission of air along the top plate and against the voice coil of the motor.

24. The method of claim 22 in which said step of providing a flow path comprises providing a space between the lower end of the frame and the upper surface of the top plate of the motor having a substantially constant height dimension from the inner edge to the outer edge of the, lower end of the frame, the overall cross sectional area of said space increasing from said inner edge to said outer edge as a result of the increase in diameter of the lower end of the frame from its inner edge to its outer edge.

25. The method of claim 22 in which said step of providing a flow path comprises providing a space between the lower end of the frame and the top plate of the motor which increases in height dimension and increases in diameter from the inner edge to the outer edge of the lower end of the frame.

* * * * *